US007803088B2

(12) United States Patent
Nakamoto et al.

(10) Patent No.: US 7,803,088 B2
(45) Date of Patent: Sep. 28, 2010

(54) GOLF CAR WITH FUEL INJECTED ENGINE AND METHOD FOR STARTING SAME

(75) Inventors: Takehiro Nakamoto, Morimachi (JP); Taikan Mizuno, Morimachi (JP)

(73) Assignee: Yamaha Motor Electronics Co., Ltd., Shizuoka (JP)

( * ) Notice: Subject to any disclaimer, the term of this patent is extended or adjusted under 35 U.S.C. 154(b) by 273 days.

(21) Appl. No.: 11/309,139

(22) Filed: Jun. 27, 2006

(65) Prior Publication Data

US 2007/0137917 A1 Jun. 21, 2007

(30) Foreign Application Priority Data

Jun. 30, 2005 (JP) ..... 2005-192003

(51) Int. Cl.
*F02M 51/00* (2006.01)

(52) U.S. Cl. ..... 477/111

(58) Field of Classification Search ..... None
See application file for complete search history.

(56) References Cited

U.S. PATENT DOCUMENTS

| | | | | |
|---|---|---|---|---|
| 4,364,343 | A * | 12/1982 | Malik | 123/179.4 |
| 5,593,367 | A * | 1/1997 | Eavenson et al. | 477/203 |
| 6,379,284 | B1 * | 4/2002 | Hanai et al. | 477/200 |
| 7,243,630 | B2 * | 7/2007 | Boe et al. | 123/179.4 |
| 7,357,118 | B2 * | 4/2008 | Fujii et al. | 123/337 |
| 2007/0245996 | A1 * | 10/2007 | Sasaki et al. | 123/179.2 |

FOREIGN PATENT DOCUMENTS

JP 2000329023 * 11/2000

* cited by examiner

*Primary Examiner*—Sherry Estremsky
(74) *Attorney, Agent, or Firm*—Keating & Bennett, LLP

(57) ABSTRACT

A system and method of operation for golf cars or the like employing electrically operated fuel injected engines for that can be operated in substantially the same manner as electrically powered cars to effect rapid restarting of the engine after stopped and with the main switch left on without excessively depleting the battery power.

8 Claims, 5 Drawing Sheets

GOLF CAR WITH FUEL INJECTED ENGINE AND METHOD FOR STARTING SAME

BACKGROUND OF THE INVENTION

This invention relates to a golf car off the type powered by a fuel injected internal combustion engine and to a method of operating such a golf car to make it more competitive with more normal golf cars having carbureted engines or ones powered electrically.

Because of the unique way in which golf cars are normally operated, it has been the normal practice to power them electrically or if internal combustion power is employed, carbureted engines have been employed even though they are less efficient than injected engines. The reason for this is that the operator or user of this type of vehicle frequently stops the vehicle without turning the main switch to its "off" position. The reason for this is that the shut off time is frequently quite short and the user does not want to have to go through a detailed start up operation over and over when completing a round of golf. In fact even when the game is over the main switch may be left in its "on" condition.

With an electric motor drive, this presents no problem as no electrical power is consumed when the electric motor is stationary. This is also true with a carbureted internal combustion engine powered golf car. Even though some electrical power is required for restarting, this can be quickly compensated for when the engine is running and its generator can quickly recharge the battery.

However fuel injected engines and particularly the most efficient ones have an electrical control system which must be powered up before starting can be done. This is the main reason why fuel injected engines have not been used, as the operator will be readily dissatisfied by the added waiting time.

It is therefore a principal object of this invention to present a solution to this problem to make the use of fuel injected engines for powering golf cars more acceptable.

SUMMARY OF THE INVENTION

A golf car embodying a first feature of the invention comprises a body portion supported on a plurality of wheels for ground travel and having a passengers' compartment adapted to accommodate at least an operator. At least one wheel is dirigibly mounted by the body portion for steering of at least one of the wheels by the operator. A fuel injected, internal combustion engine is mounted by the body portion and adapted to drive at least one of the wheels through a transmission. An electrically operated fuel injector delivers fuel to the engine for its operation. An operator controlled accelerator for electrically operating the electrically operated fuel injector for controlling the operation of the engine between a non running condition and a running speed. A main switch controls the electrical operation of the golf car including the electrically operated fuel injector between an "off" condition and an "on" condition responsive to operator determined demand. Electrical power is continued to the electrically operated fuel injector in response to operator determined demand until a predetermined condition exists. Then the electric power is discontinued upon the occurrence of the predetermined condition.

Another feature of the invention is embodied in a golf car comprising a body portion supported on a plurality of wheels for ground travel and having a passengers' compartment adapted to accommodate at least an operator. At least one wheel is dirigibly mounted by the body portion for steering of at least one of the wheels by the operator. A fuel injected, internal combustion engine is mounted by the body portion and adapted to drive at least one of said wheels through a transmission. An electrically operated fuel injector delivers fuel to the engine for its operation. An operator controlled accelerator electrically operates the electrically operated fuel injector for controlling the operation of the engine between a non running condition and a running condition. A main switch controls the electrical operation of the golf car including the electrically operated fuel injector between an "off" condition and an "on" condition responsive to operator determined demand. In accordance with this feature of the invention, a holding circuit supplies electrical power to the electrically operated fuel injector in response to operator determined demand until a predetermined condition exists.

DETAILED DESCRIPTION

Figure 1:
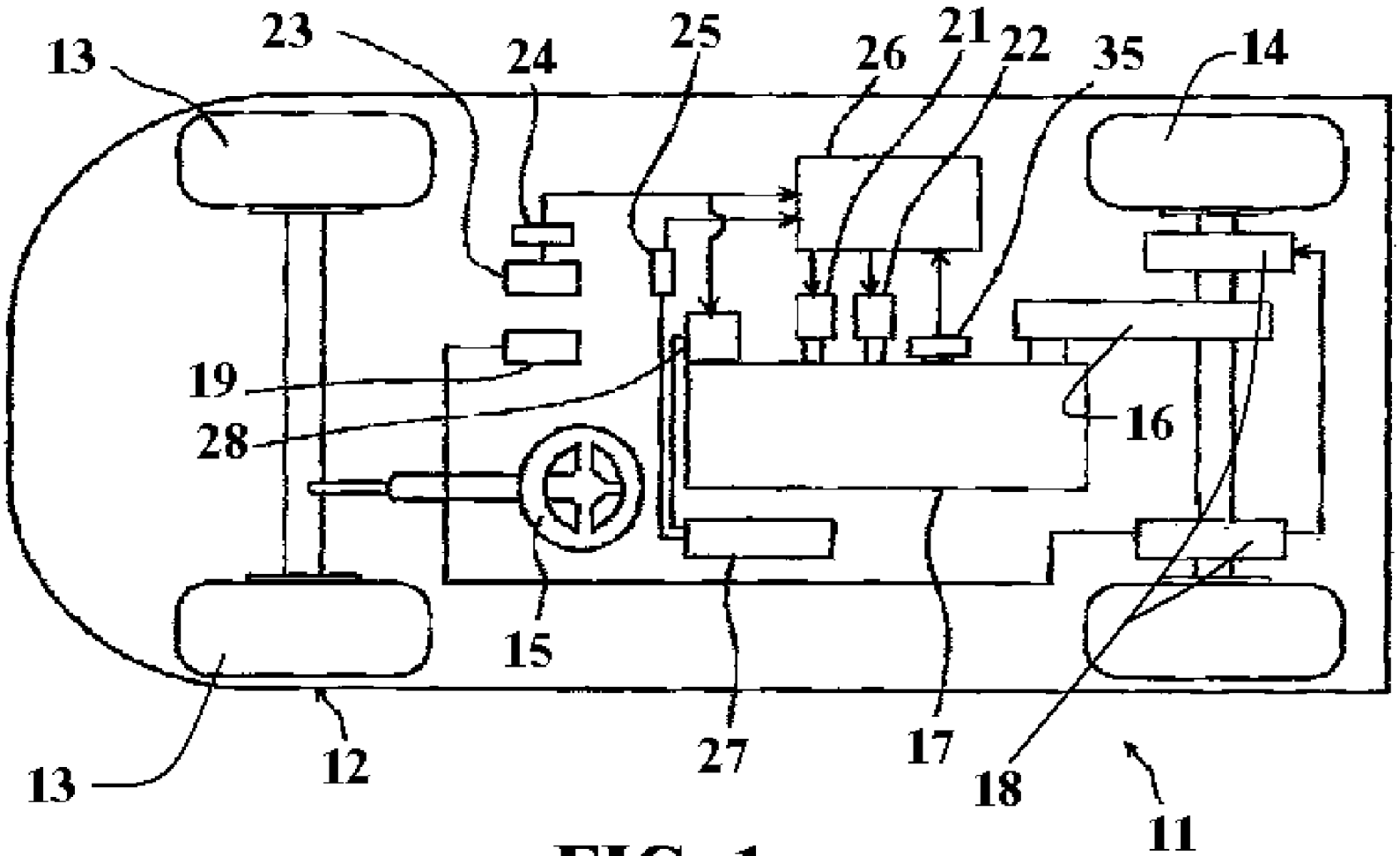
FIG. 1 is a partially schematic top plan view of a fuel injected, internal combustion engine powered golf car constructed and operated in accordance with the invention.

Referring now in detail to the drawings and initially to FIG. 1, A golf car embodying the invention is identified generally by the reference numeral 11 is comprised of a body portion 12 that may have any desired configuration and construction. This body portion 12 dirigibly supports, in a desired manner and through a suspension system, not shown, front wheels 13. In addition the body portion 12 further supports, again through any desired suspension structure, rear wheels 14.

The front wheels 13 are steered by an operator of the car 11 by a suitable steering mechanism by means of a steering wheel 15. The rear wheels 14 are driven through a transmission 16 from a fuel injected internal combustion engine, indicated generally by the reference numeral 17. At least the rear wheels 14 are provided with brakes 18 of a suitable type operated by means of a brake pedal 19 positioned in proximity to the operator.

The engine 17 includes an ignition system 21 of any desired type for firing spark plugs (not shown) in accordance with any desired control routine. The engine 17 is supplied with fuel via one or more fuel injectors, represented schematically at 22. The engine operation is under the control of an accelerator pedal 23 that is disposed adjacent the brake pedal 19. An accelerator position detector 24 detects depressing operation of the accelerator pedal 23 by the operator. In the illustrated embodiment, when the operator depresses the accelerator pedal 23 the detector 24 outputs a signal so that the engine 17 and car 11 is driven at a constant speed. Of course those skilled in the art will readily understand how the invention can be practiced with systems wherein the engine and car speed may be variable, The accelerator position detector 24 and a key operated main switch 25 are connected to an engine controller, indicated generally at 26. The controller 26 is supplied with power from a battery 27. For charging the battery 27 and providing electrical power for operation of the car 11 there is provided a starter generator 28.

Figure 2:
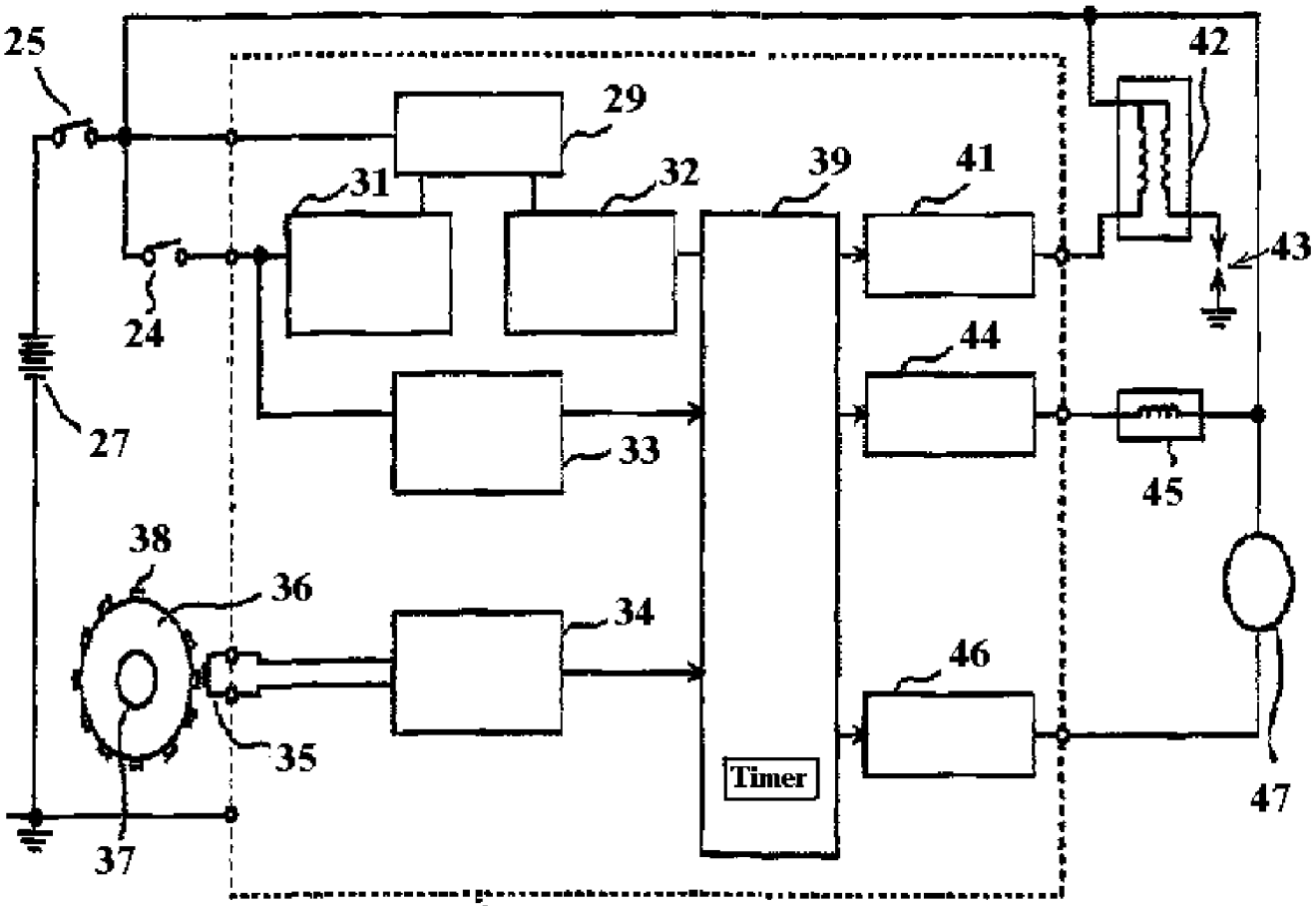
FIG. 2 is a schematic view of the control system constructed and operated in accordance with the invention.
Figure 3:
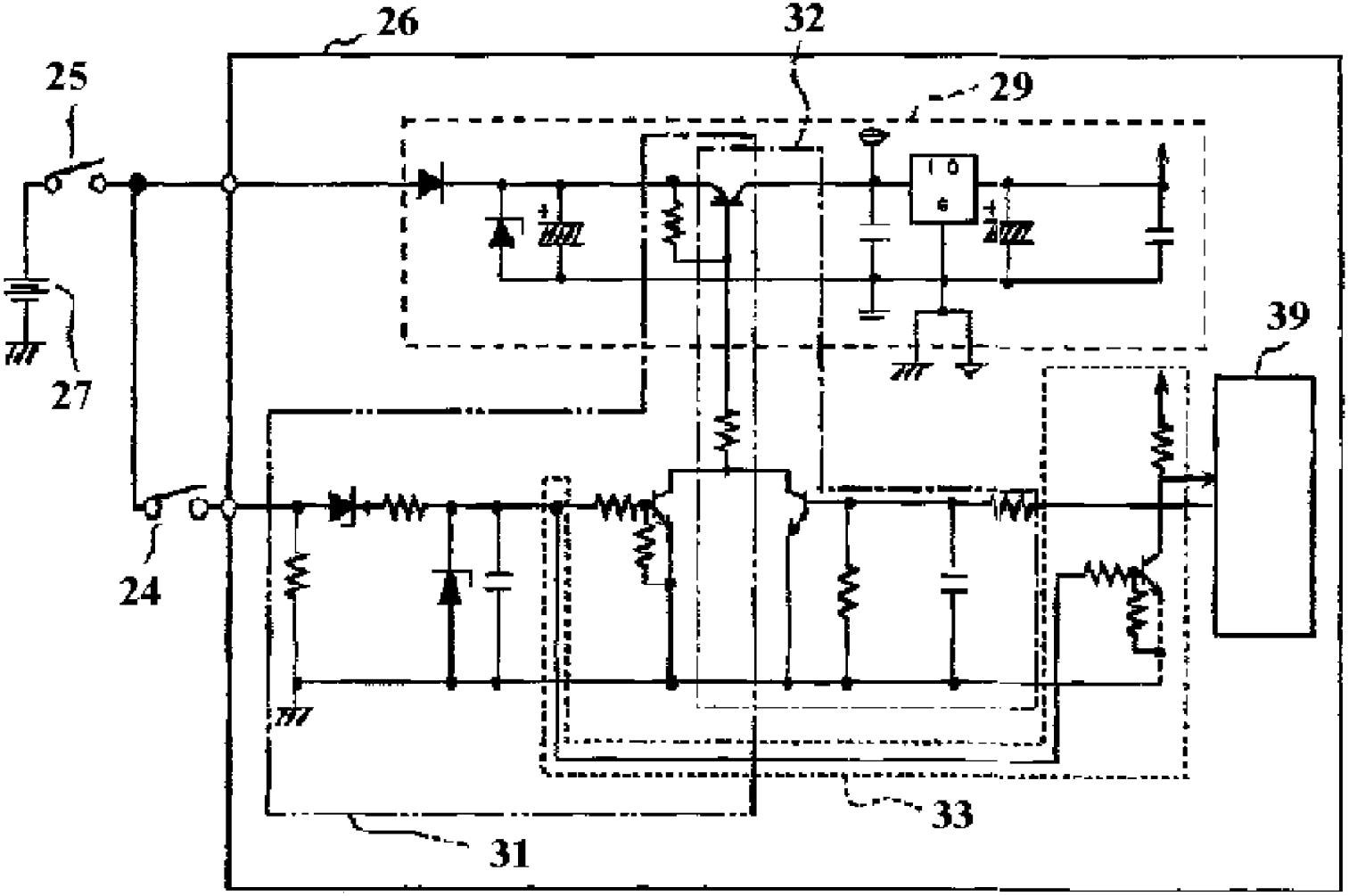
FIG. 3 is a schematic electrical diagram of the control system constructed and operated in accordance with the invention.

The electrical control system will now be described in detail by reference primarily to FIGS. 2 and 3. The controller (ECU) 26 is comprised of the following elements and their connections. A power supply circuit 29 is connected to the battery 27 via the main switch 25. A power-ON circuit 31 is connected to the accelerator position detector 24. A self-holding circuit for power supply 32 is connected to the power supply circuit 29. An accelerator position detector input circuit 33 is connected to the accelerator position detector 24.

In addition engine operating conditions are determined from a crankshaft input circuit 34 connected to a crankshaft position sensor 35. The crankshaft position sensor cooperates with a rotor 36 fixed for rotation with a crankshaft, indicated schematically at 37, of the engine 17. The crankshaft position sensor 35 cooperates with pulser projections 38 provided around the rotor 36 to detect rotation conditions of the crankshaft 37 (such as rotational speed and if the crankshaft is rotating or not). That information is converted by the crank input circuit 34 into a crank signal to input to a microprocessor (CPU) 39.

The microprocessor 39 controls engine operation through the controller 26 and specifically an ignition output circuit 41 for controlling battery output to drive an ignition coil 42 that, in turn, fires one or more spark plugs 43 of the engine 17. In addition the microprocessor 39 controls an injection output circuit 44 for electrically driving a fuel injector 45 and, in addition, a fuel pump output circuit 46 for driving an electrically operated fuel pump 47. The ignition output circuit 41 and the ignition coil 42 form the ignition device identified by the reference numeral 21 in FIG. 1 while the injection output circuit 44, the pump output circuit 46, the fuel pump 47 and the injector 45 form the fuel injector identified by the reference numeral 22.

Control Routine

Figure 4:
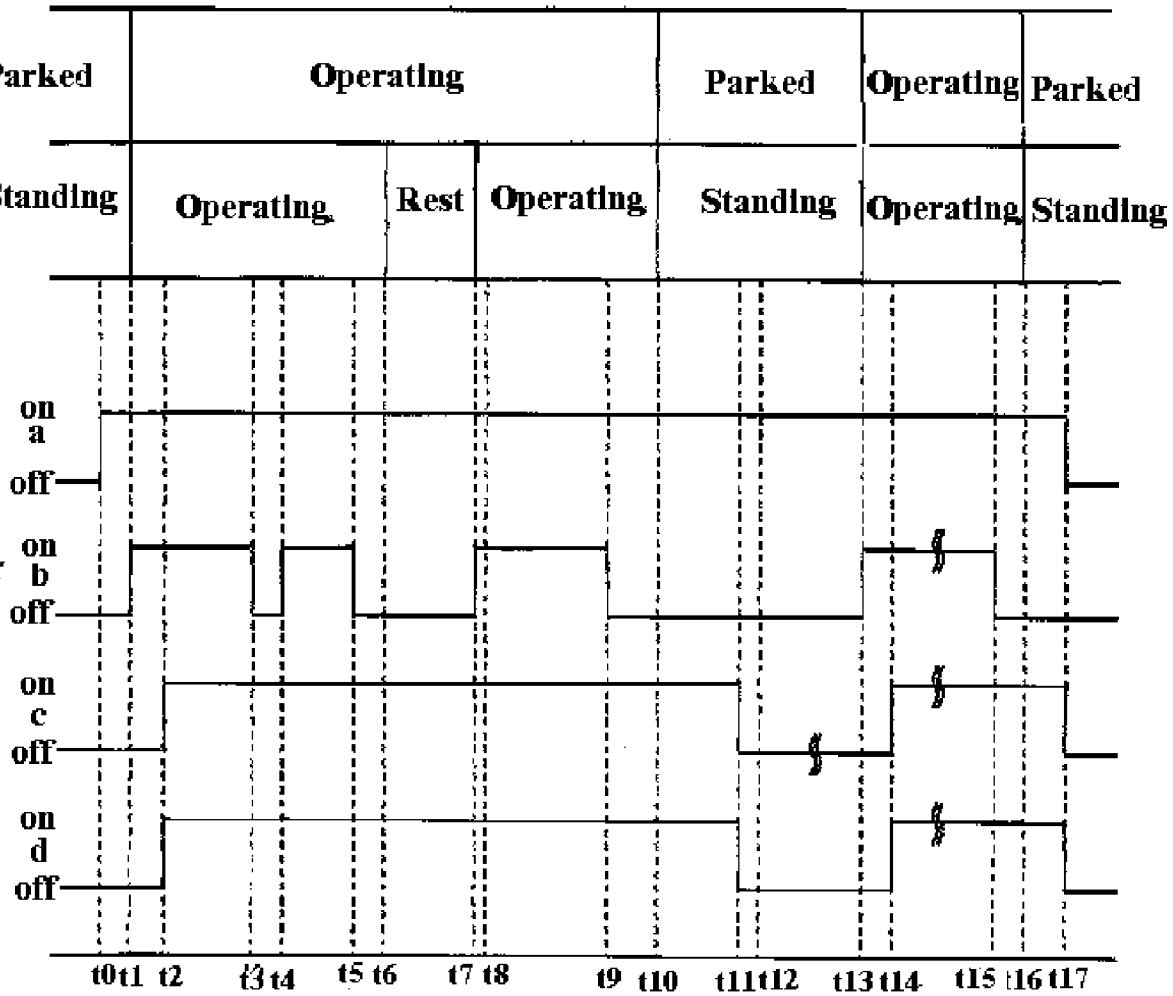
FIG. 4 is a time diagram showing several storage and use cycles of the golf cart to illustrate the invention.
Figure 5:
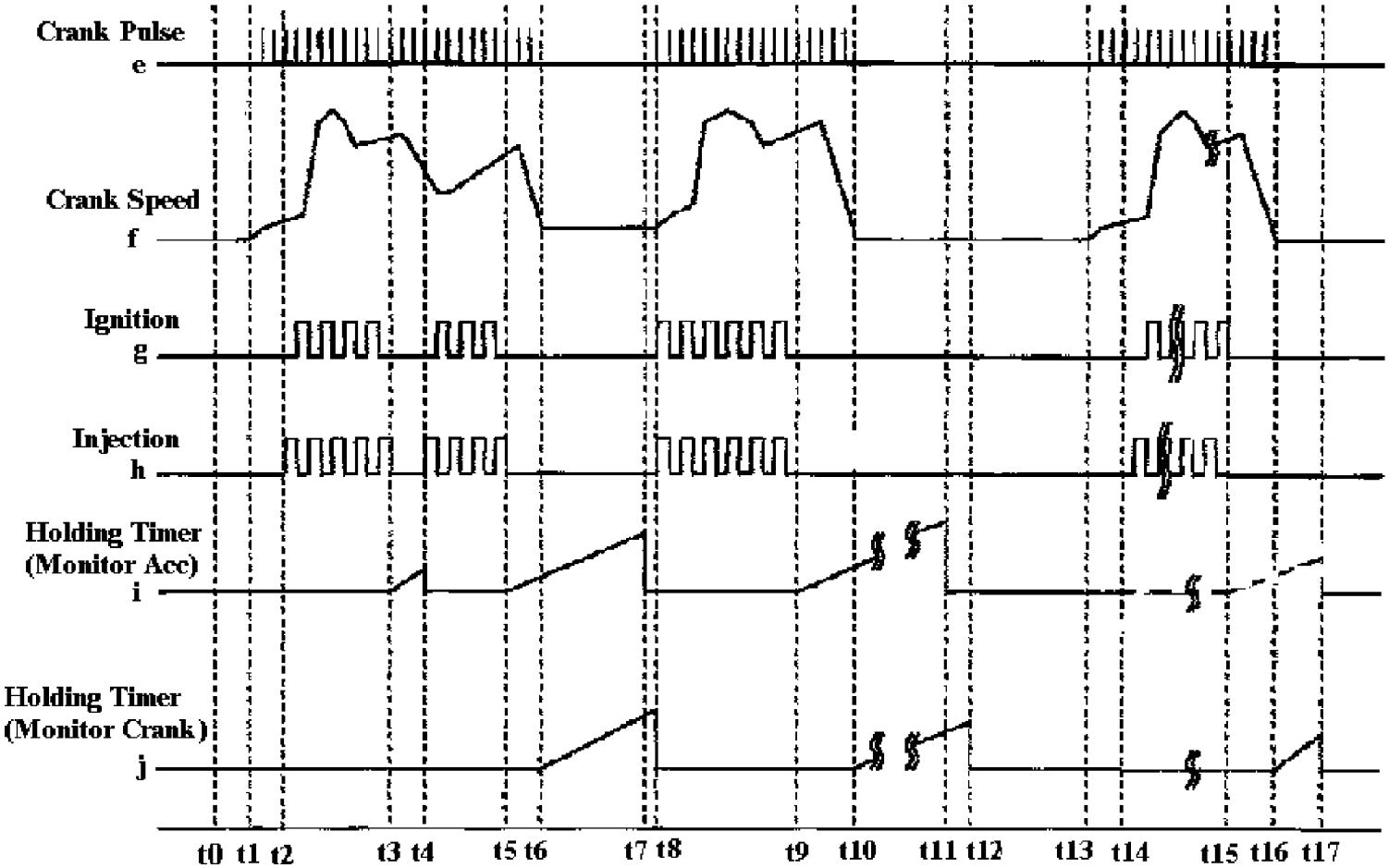
FIG. 5 is a continuation of the time diagram showing certain electrical conditions during the several storage and use cycles of the golf cart shown in FIG. 4 and using the same time scale.

The way in which the program for permitting rapid restarting of the fuel injected internal combustion engine 17 after a delay of non use and without depleting the charge of the battery 27 will now be described by reference to FIGS. 4 and 5, by way of example that should show the variations possible to those skilled in the art. There is illustrated time periods t0 to t17 in these figures and the intervals are the same in each figure to facilitate understanding of the theory and method of operation.

As an example, prior to the time t0 it has been assumed that the golf car 11 has been stored for a relatively long time period and the main switch 25 has been switched "Off". Thus the accelerator position detector senses a 0 position, the microprocessor 39 is switched "Off" and the self holding circuit for the power supply is also "Off". No signals are sensed by any of the sensors.

Then at the time t0 the operator desires to use the golf car 11 and accordingly turns the main switch 25 "On" with the appropriate key. At this point in time, the battery 27 is connected to the ECU. However, since the accelerator position detector 24 is OFF, no power is supplied at this time.

Next at the time t1, the accelerator pedal 23 is depressed to switch the accelerator position detector 24 "On" as shown by the trace b. This allows power supply to the ECU 39 while allowing the starter 28 to rotate to start cranking the engine 17, that is, the crankshaft 37 begins rotating as shown by the traces e and f.

Then at the time t2, the ECU 39 is activated with a time lag or after given start-up time from t1 as seen from the trace c. This allows the microprocessor (CPU) 39 to provide an output intended for continuously supplying power to the ECU, trace d, so that the self-holding circuit for power supply 32 starts operating and the ECU is kept powered "On". Immediately after this point in time, ignition outputs are provided at a predetermined ignition timing seen by the trace g. Concurrently with that, the injector 45 is supplied with fuel by the pump 47 and injects fuel at a given injection timing shown by the trace h. This allows the engine 17 to start, while allowing the cranking of the engine by the starter to be completed, so that the engine rotates by itself.

Considering now that at the time t3, the operator desires to decelerate the moving golf car 11. He does this by releasing the accelerator pedal 23 to the original off position, which causes the accelerator position detector 24 to turn "Off as shown again by trace b. Thereby, ignition and injection outputs are stopped as shown by traces g and h, and therefore engine power is cut off. This causes the crankshaft rotational speed to start decreasing as seen by trace f.

At this point in time, a self-holding timer, which is incorporated in the CPU 39 (FIG. 2), is activated to begin counting time as shown by trace i. The self-holding timer operates based on the program stored so that when the time counted by the self-holding timer exceeds a predetermined time period (for example 10 hours) the self-holding function maintaining the power "On" state is cleared. The timer may be configured to operate based on the detected crank pulses (trace j). By way of example, if the crankshaft is still rotating due to inertia at the time of the switch "Off" of the accelerator position detector 24, the timer will not start counting the time.

If the operator desires to reaccelerate the golf car after deceleration at the time t4, the accelerator pedal 23 is actuated and, as a result, the accelerator position detector 24 is switched "On" as shown by trace b. Since the current time counted by the timer has not yet exceeded the predetermined time, the timer is reset as seen from trace i. The ECU is already active because of the self-holding function to maintain the powered-ON state. Thus, no start-up time is needed and ignition and injection start immediately to provide engine power as seen from traces g and h. Thus the crankshaft rotational speed increases see trace f.

Now consider the condition that the golf car is stopped while golfing a round or for a break at the time t5. Because the accelerator pedal 23 is released, the accelerator position detector is switched OFF (see trace b). Subsequently, the ignition outputs (trace g) and injection outputs (trace h) are stopped. Thus, engine power is cut off, and therefore the crankshaft rotational speed decreases (trace f). At the same time, the timer starts counting time (trace i).

Then at the time t6 rotation of the crankshaft completely stops (trace f), and no crank pulse is detected (trace e). Thus if the timer operates based on monitoring the crank pulses, the timer starts counting time at this point (trace j).

Consider now that at the time t7 it is desired to start the golf car 11 from a standstill to move to another location. The predetermined time (10 hours) has not yet passed, but the accelerator position detector 24 is switched "Off" (trace b). This causes the timer, which operates based on monitoring the accelerator position detector, to be reset (trace i). The self-holding function to keep the powered "On" state is maintained (trace d), so that the ECU operation continues (trace c).

Since the ECU 25 is already active and needs no start-up time, the ignition and injection outputs are provided (lines g and h) immediately after time t7 at time t8. This is no longer than the time period from t1 to t2 which contains the start-up time. Thus the crankshaft rotates by itself (trace f) and a crank pulse signal is inputted to the ECU (trace e). The predetermined time (10 hours) has not yet passed at this point in time. Therefore, the timer, which operates based on monitoring the crank pulses, is reset (trace j).

After the round is over, at the time t9 the golf car is moved to the garage and the engine is stopped for parking. The accelerator position detector is switched OFF (trace b). The ignition outputs (trace g) and the injection outputs (trace h) are both stopped. Subsequently, the crankshaft rotational speed decreases and the engine is stopped (trace f). The main switch remains ON (trace a). Thus, the self-holding function to keep the powered-ON state is maintained (trace d), so that the ECU operation continues (trace c). At this point in time, the timer, which operates based on monitoring the accelerator position detector, is activated (trace i).

Now consider that at the time t10 that the engine 17 is stopped completely and the crankshaft rotational speed decreases to zero (trace f). This results in no crank pulse signal (trace e). At this point in time, the timer, which operates based on monitoring the crank pulses, is activated (trace j).

If at the time t11 the time counted by the self-holding timer, which operates based on monitoring the accelerator position detector 24, has passed the predetermined time (10 hours in the assumed example), an output intended for keeping the power "On" state is stopped. This results in no power supply to the ECU 26 (trace d). Thereby, the ECU 26 operation stops (trace c). The engine 17 remains stopped (lines e, f, g and h). The main switch remains "On" (trace a). That is even though the main switch 25 is left turned "On", the accelerator pedal 23 was released to switch the accelerator position detector "Off" to stop and park the golf car 11 in the garage. As described above, even though the main switch 25 remains ON for a long time, the engine 17 is stopped to park the golf car 11 in the garage. In the course of this process, the self-holding function is shut off to stop supplying power to the ECU, which prevents unnecessary battery power consumption.

On the other hand, if the timer, which operates based on monitoring the crank pulses (trace j), is used in place of the timer, which operates based on monitoring the accelerator position detector, when the time counted by the timer has passed the predetermined time (10 hours) at the time t12, an output intended for maintaining the powered-ON state is stopped. This results in no power supply to the ECU (trace d). Thereby, the ECU operation stops at the time t11 (trace c), as in the case with the timer that operates based on monitoring the accelerator position detector. The engine remains stopped (lines e, f, g and h) even though the main switch 25 remains "On" (trace a). More specifically, as previously discussed with respect to the time t12, while the main switch remains ON for a long time, the engine is stopped to park the golf car in the garage. In the course of this process, the self-holding function is shut off to stop supplying power to the ECU, which prevents unnecessary battery power consumption.

Consider now that at the time t13 that the golf car is moved out of the garage for use in the next day or so. The conditions are almost the same as those at the time t1. That is, the accelerator position detector is switched ON (trace b). This allows power supply to the ECU while allowing the starter 28 to rotate to start cranking the engine, that is, the crankshaft 37 begins rotating (lines e and f).

Then at the time t14 the ECU 39 is activated with a time lag or after given start-up time from t13 (trace c). This allows the microprocessor (CPU) 39 to provide an output intended for continuously supplying power to the ECU (trace d) so that the self-holding circuit for power supply 32 starts operating by which the ECU is kept powered "On". Immediately after this point in time, ignition outputs are provided at a predetermined ignition timing (trace g). Concurrently with that, the injector 22 injects fuel at a given injection timing (trace h). This allows the engine 17 to start, while allowing the cranking of the engine 17 by the starter 28 to be completed, so that the engine 17 rotates by itself.

Then assuming at the time t15, as previously discussed at the time t9, after the round is over, the golf car 11 is moved to the garage and the engine 17 is stopped for parking. The accelerator position detector 24 is switched "Off" (trace b). The ignition outputs (trace g) and the injection outputs (trace h) are both stopped. Subsequently, the crankshaft rotational speed decreases and the engine is stopped (trace f). The main switch remains "On" (trace a). Thus, the self-holding function to keep the powered-"On" state is maintained (trace d), so that the ECU operation continues (trace c). At this point in time, the timer, which operates based on monitoring the accelerator position detector, is activated (trace i).

Now if at the time t16 and as previously discussed for the time t10, the engine 17 is stopped completely and the crankshaft rotational speed decreases to zero (trace f), this results in no crank pulse signal (trace e). At this point in time, the timer, which operates based on monitoring the crank pulses, is activated (trace j). The self-holding function to keep the powered "On" state is maintained (trace d), so that the ECU operation continues (trace c).

Then at the time t17 the engine is stopped while the self-holding function to keep the ECU powered "On" is maintained even though the main switch 25 is: Off". Switching the main switch 25 "Off" (trace a) immediately results in no output intended for keeping the ECU 26 powered "On" (trace d), thereby stopping power supply to the ECU 26 and therefore stopping the ECU operation. This prevents unnecessary battery power consumption.

It should be readily apparent to those skilled in the art from the foregoing description that the described system and its method of operation permits the use of electrically operated fuel injected engines for golf cars or the like that can be operated in substantially the same manner as electrically powered ones to effect rapid restarting of the engine after stopped and with the main switch left on without excessively depleting the battery power. Of course those skilled in the art will readily understand that the described embodiments are only exemplary forms that the invention may take and that various changes and modifications may be made without departing from the spirit and scope of the invention, as defined by the appended claims.

What is claimed is:

1. A golf car comprising:

a body portion supported on a plurality of wheels and including a passengers' compartment arranged to accommodate at least an operator, at least one of said plurality of wheels mounted to said body portion and arranged to be steered by the operator, a fuel injected, internal combustion engine mounted to said body portion and arranged to drive at least one of said plurality of wheels through a transmission, an electrically operated fuel injector arranged to deliver fuel to said engine, an operator controlled accelerator arranged to electrically operate said electrically operated fuel injector and to control the operation of said engine between a non running condition and a running condition, a main switch arranged to control supply of electrical power to said electrically operated fuel injector, the main switch being arranged to move between an "off" condition and an "on" condition, and a holding circuit arranged to supply electrical power to said electrically operated fuel injector in response to operator demands until a predetermined condition exists after which the electrical power supplied to the electrically operated fuel injector is stopped even when the main switch is in the "on" condition.

2. A golf car as set forth in claim 1, wherein the predetermined condition is a time period.

3. A golf car as set forth in claim 1, wherein the holding circuit is switched to an "off" condition if the main switch is switched to the "off" condition during the predetermined condition.

4. A golf car as set forth in claim 3, wherein the predetermined condition is a time period.

5. A method of operating a golf car comprising:

providing a body portion supported on a plurality of wheels and including a passengers' compartment arranged to accommodate at least an operator, providing at least one of the plurality of wheels mounted to the body portion so as to be arranged to be steered by the operator, providing a fuel injected, internal combustion engine mounted to the body portion and arranged to drive at least one of the plurality of wheels through a transmission, providing an electrically operated fuel injector arranged to deliver fuel to the engine, providing an operator controlled accelerator arranged to operate the electrically operated fuel injector and to control the operation of the engine between a non running condition and a running condition, providing a main switch arranged to control supply of electrical power to the electrically operated fuel injector, the main switch being arranged to move between an "off" condition and an "on" condition and a step of supplying electrical power to the electrically operated fuel injector in response to operator demands until a predetermined condition exists after which the electrical power supplied to the electrically operated fuel injector is stopped even when the main switch is in the "on" condition.

6. A method of operating a golf car as set forth in claim 5, wherein the predetermined condition is a time period.

7. A golf car as set forth in claim 5, wherein the holding circuit is switched to an "off" condition if the main switch is switched to the "off" condition during the predetermined condition.

8. A golf car as set forth in claim 7, wherein the predetermined condition is a time period.

* * * * *